US010252438B2

(12) United States Patent
Myrhum, Jr. et al.

(10) Patent No.: US 10,252,438 B2
(45) Date of Patent: Apr. 9, 2019

(54) HAND-HELD KNOCKOUT PUNCH DRIVER

(71) Applicant: Milwaukee Electric Tool Corporation, Brookfield, WI (US)

(72) Inventors: James O. Myrhum, Jr., West Bend, WI (US); Troy C. Thorson, Cedarburg, WI (US); Koon For Chung, Hong Kong (CN)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 15/188,022

(22) Filed: Jun. 21, 2016

(65) Prior Publication Data

US 2016/0303755 A1 Oct. 20, 2016

Related U.S. Application Data

(63) Continuation of application No. 13/444,772, filed on Apr. 11, 2012, now Pat. No. 9,393,711.

(60) Provisional application No. 61/474,156, filed on Apr. 11, 2011.

(51) Int. Cl.

| | |
|---|---|
| ***B26F 1/38*** | (2006.01) |
| ***B26F 1/34*** | (2006.01) |
| ***B21D 28/34*** | (2006.01) |
| ***B26D 5/08*** | (2006.01) |
| ***B26F 1/36*** | (2006.01) |

(52) U.S. Cl.

CPC ..... *B26F 1/34* (2013.01); *B21D 28/343* (2013.01); *B26D 5/086* (2013.01); *B26F 1/36* (2013.01); *B26F 1/38* (2013.01)

(58) Field of Classification Search

CPC ..... B26F 1/36; B26F 1/386; B26F 2210/16
USPC ..... 173/201, 130, 217, 213; 1/201, 130
See application file for complete search history.

(56) References Cited

U.S. PATENT DOCUMENTS

| | | | | |
|---|---|---|---|---|
| 1,151,032 | A | | 8/1915 | Moore |
| 1,279,362 | A | | 9/1918 | Krueger |
| 1,583,715 | A | | 5/1926 | Houston |
| 1,721,007 | A | | 7/1929 | Doherty et al. |
| 1,726,012 | A | | 8/1929 | Bilz |
| 1,754,568 | A | | 4/1930 | Nischan |
| 2,448,817 | A | | 9/1948 | McArthur |
| 2,536,452 | A | | 1/1951 | Leissler |
| 2,608,253 | A | | 8/1952 | Battles et al. |
| 2,634,987 | A | | 4/1953 | Palmer |
| 2,735,489 | A | | 2/1956 | Fowler |
| 2,808,108 | A | | 10/1957 | Pellegrino |
| 2,991,601 | A | | 7/1961 | Glatter et al. |
| 3,269,011 | A | | 8/1966 | Herrstrum |
| 3,288,501 | A | | 11/1966 | Ross et al. |
| 3,335,627 | A | | 8/1967 | Smelts |
| 3,425,219 | A | | 2/1969 | Oliver et al. |
| 3,548,700 | A | | 12/1970 | Herzog et al. |
| 3,640,364 | A | | 2/1972 | Utton |
| 3,924,330 | A | * | 12/1975 | Mitsuhashi ..... B21D 28/002 30/358 |
| 3,935,771 | A | | 2/1976 | Cady, Jr. |

(Continued)

*Primary Examiner* — Gloria R Weeks
(74) *Attorney, Agent, or Firm* — Michael Best & Friedrich LLP

(57) ABSTRACT

A hand-held knockout punch driver includes a housing, a motor positioned within the housing, and a head unit removably coupled to the housing. The head unit includes a draw rod to which at least one of a punch or a die is attachable.

18 Claims, 12 Drawing Sheets

(56) References Cited

U.S. PATENT DOCUMENTS 4,131,165 A * 12/1978 Wanner ..... B23Q 3/12 173/133
4,349,074 A * 9/1982 Ince ..... B25D 9/08 173/48
4,378,053 A * 3/1983 Simpson ..... B25D 17/08 173/109
4,403,417 A 9/1983 Wilson et al.
4,434,859 A * 3/1984 Rumpp ..... B23Q 3/12 173/48
4,491,444 A * 1/1985 Rumpp ..... B22D 11/122 409/234
4,491,445 A * 1/1985 Hunger ..... B23B 31/123 409/234
4,495,699 A 1/1985 Oakes
4,502,824 A * 3/1985 Dohse ..... B23Q 3/12 173/13
4,529,044 A * 7/1985 Klueber ..... B25D 16/00 173/109
4,571,975 A * 2/1986 Pawloski ..... B21D 39/034 137/625.68
4,594,779 A 6/1986 Hagemeyer
4,667,411 A * 5/1987 McCallum ..... B26D 7/015 30/362
4,720,219 A 1/1988 Masonek et al.
4,793,063 A 12/1988 Ducret
4,898,250 A * 2/1990 Neumaier ..... B25D 16/006 173/104
4,899,447 A 2/1990 Adleman
4,905,557 A 2/1990 Adleman
4,975,001 A 12/1990 Rabo et al.
5,013,193 A 5/1991 Rabo et al.
5,020,407 A 6/1991 Brinlee
5,056,391 A 10/1991 Stewart
5,190,392 A 3/1993 Parma et al.
5,233,749 A * 8/1993 Saito ..... B21D 28/002 30/228
5,271,303 A 12/1993 Chatham
5,282,378 A * 2/1994 Kimura ..... B21D 28/002 29/751
5,342,155 A 8/1994 Harroun
5,405,347 A 4/1995 Lee et al.
5,416,975 A * 5/1995 Saito ..... B21D 28/243 30/228
5,425,558 A 6/1995 Dennany, Jr.
5,593,265 A 1/1997 Kizer
5,598,635 A * 2/1997 Saito ..... B21D 28/243 30/228
5,624,213 A * 4/1997 Anderson ..... B23B 51/0473 144/23
5,626,433 A 5/1997 Iwamoto
5,647,256 A 7/1997 Schneider
5,833,383 A 11/1998 Bauman
5,842,527 A * 12/1998 Arakawa ..... B25D 16/006 173/48
5,911,800 A 6/1999 Roberts et al.
D420,020 S * 2/2000 Morita ..... D15/128
6,047,621 A 4/2000 Dries et al.
6,126,359 A 4/2000 Dittrich et al.
6,148,710 A 11/2000 Pottorff
6,161,279 A 12/2000 Suboski
6,209,208 B1 7/2001 Marinkovich et al.
6,279,445 B1 8/2001 Rosene et al.
6,305,889 B1 10/2001 Blessing et al.
6,367,362 B1 4/2002 Brazell et al.
6,401,345 B1 * 6/2002 Liaw ..... B26F 1/34 30/358
6,485,218 B1 11/2002 Martinosky
6,655,473 B1 * 12/2003 Chi ..... B25B 21/00 173/176
6,754,967 B2 6/2004 Lovell et al.
6,796,921 B1 * 9/2004 Buck ..... B25F 5/001 173/47
6,840,698 B2 1/2005 Cattaneo
6,857,830 B2 * 2/2005 Holcomb ..... B23B 49/02 408/115 R
6,860,670 B2 3/2005 Jeffries
6,877,927 B2 4/2005 Paulin et al.
6,953,197 B2 10/2005 Hartmann
7,090,700 B2 8/2006 Curtis
7,125,192 B2 10/2006 Yokota
7,137,457 B2 * 11/2006 Frauhammer ..... B23Q 3/12 173/29
7,185,713 B2 * 3/2007 Lee ..... B23B 45/008 173/176
7,228,776 B2 * 6/2007 Case ..... B21D 28/343 279/8
7,316,404 B1 1/2008 Walker
7,367,757 B2 * 5/2008 Phillips ..... B23B 45/003 173/214
7,698,979 B2 4/2010 Sugizaki et al.
7,726,554 B2 6/2010 Thielges et al.
7,797,840 B2 * 9/2010 Bublitz ..... B21D 28/243 30/358
7,927,036 B2 4/2011 Reasoner
7,980,781 B2 7/2011 Trice
8,007,196 B2 8/2011 Whitling et al.
8,327,745 B2 12/2012 Lee et al.
8,366,341 B2 2/2013 Bevirt
8,387,719 B2 * 3/2013 Scrimshaw ..... 173/104
8,408,111 B2 4/2013 Johnston et al.
8,584,581 B2 11/2013 Curtin
8,657,594 B2 2/2014 Atagi et al.
8,714,065 B2 5/2014 Takahashi et al.
8,904,911 B2 12/2014 Nordlin
9,199,389 B2 * 12/2015 Myrhum, Jr. ..... B21D 28/343
2002/0002775 A1 1/2002 Kimura
2002/0007714 A1 1/2002 Ohtsuka et al.
2003/0029295 A1 * 2/2003 Yoshimizu ..... B23D 15/04 83/697
2004/0200333 A1 10/2004 Seeley et al.
2005/0224243 A1 * 10/2005 Baumann ..... B25D 17/088 173/128
2008/0011135 A1 1/2008 Ray
2008/0092713 A1 4/2008 Takahashi et al.
2008/0210076 A1 9/2008 Bublitz et al.
2008/0302548 A1 * 12/2008 Berger ..... B25D 17/00 173/5
2009/0110477 A1 4/2009 Seger
2009/0145620 A1 * 6/2009 Cycon ..... B25D 17/02 173/201
2009/0224534 A1 9/2009 Liu
2010/0025059 A1 * 2/2010 Felger ..... B25D 16/006 173/47
2010/0031492 A1 2/2010 Lee et al.
2010/0107832 A1 5/2010 Johnston et al.
2010/0180744 A1 7/2010 Nordlin
2010/0282485 A1 * 11/2010 Puzio ..... B23B 31/1074 173/217
2013/0305544 A1 11/2013 Haase
2013/0333578 A1 12/2013 Lee et al.
2014/0338940 A1 * 11/2014 Kelleher ..... B25D 11/00 173/48
2015/0096778 A1 * 4/2015 Schneider ..... B25B 21/002 173/213
2015/0343583 A1 * 12/2015 McRoberts ..... B23Q 5/045 173/213

* cited by examiner

HAND-HELD KNOCKOUT PUNCH DRIVER

CROSS-REFERENCE TO RELATED APPLICATIONS

This application is a continuation of co-pending U.S. patent application Ser. No. 13/444,772 filed on Apr. 11, 2012, which claims priority to U.S. Provisional Patent Application No. 61/474,156 filed on Apr. 11, 2011, the entire contents of both of which are incorporated herein by reference.

BACKGROUND OF THE INVENTION

The present invention relates to knockout punches and, more particularly, to powered knockout drivers.

Knockout drivers are generally used in combination with a punch and die set to form apertures within sheet material, such as sheet steel and the like. The punching process is accomplished by providing a large force between the die and punch, causing the punch to pierce the sheet material and form the desired aperture. The force can be produced in a number of ways, such as manually, hydraulically, and the like. Typically, manual embodiments are limited by the size of hole they can create while most hydraulic powered systems can be bulky.

SUMMARY OF THE INVENTION

The invention provides, in one aspect, a hand-held knockout punch driver including a housing, a motor positioned within the housing, and a head unit removably coupled to the housing. The head unit includes a draw rod to which at least one of a punch or a die is attachable.

Other features and aspects of the invention will become apparent by consideration of the following detailed description and accompanying drawings.

BRIEF DESCRIPTION OF THE INVENTION

Figure 2:
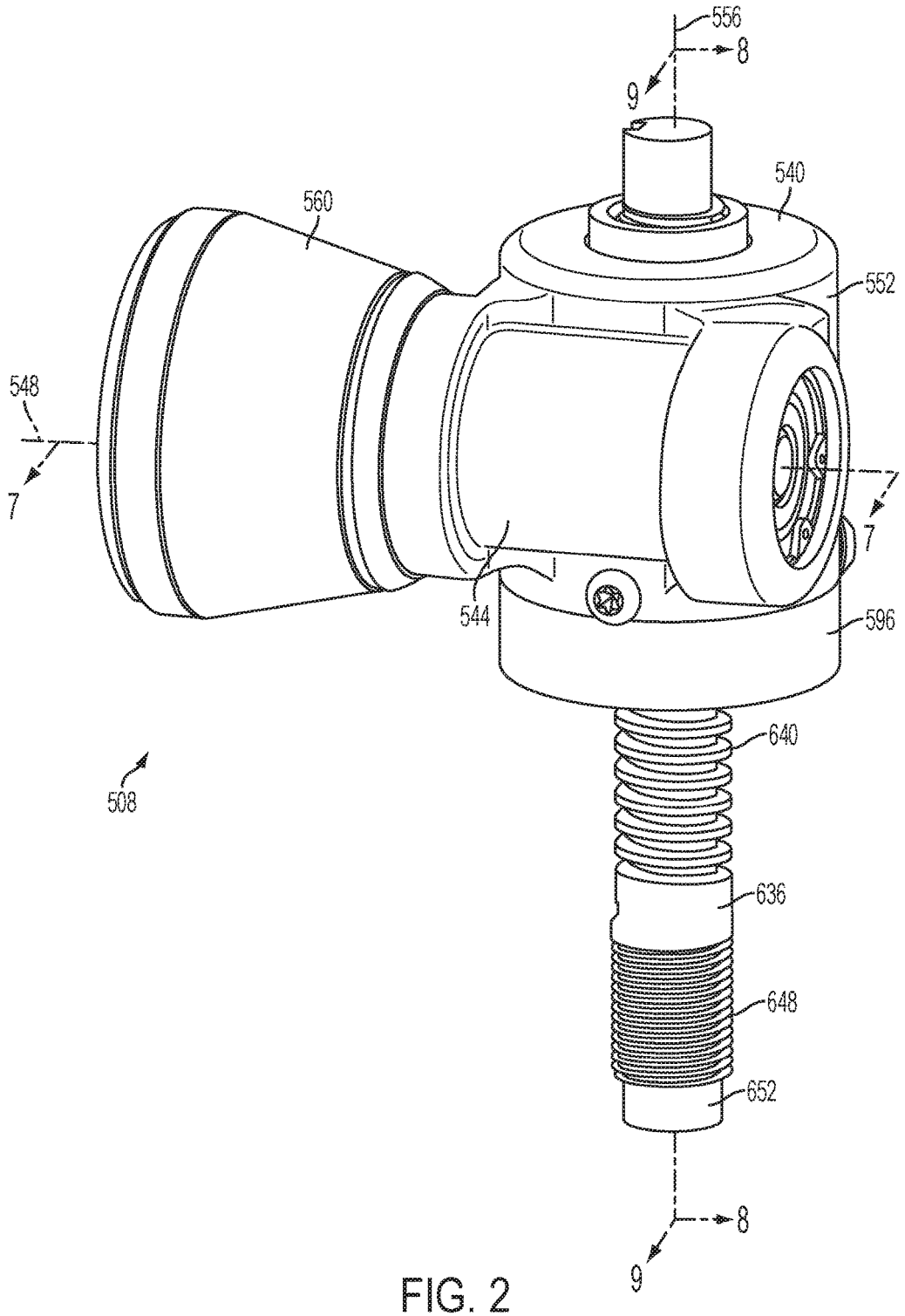
FIG. 2 is a perspective view of a head unit of the knockout driver shown in FIG. 1.
Figure 3:
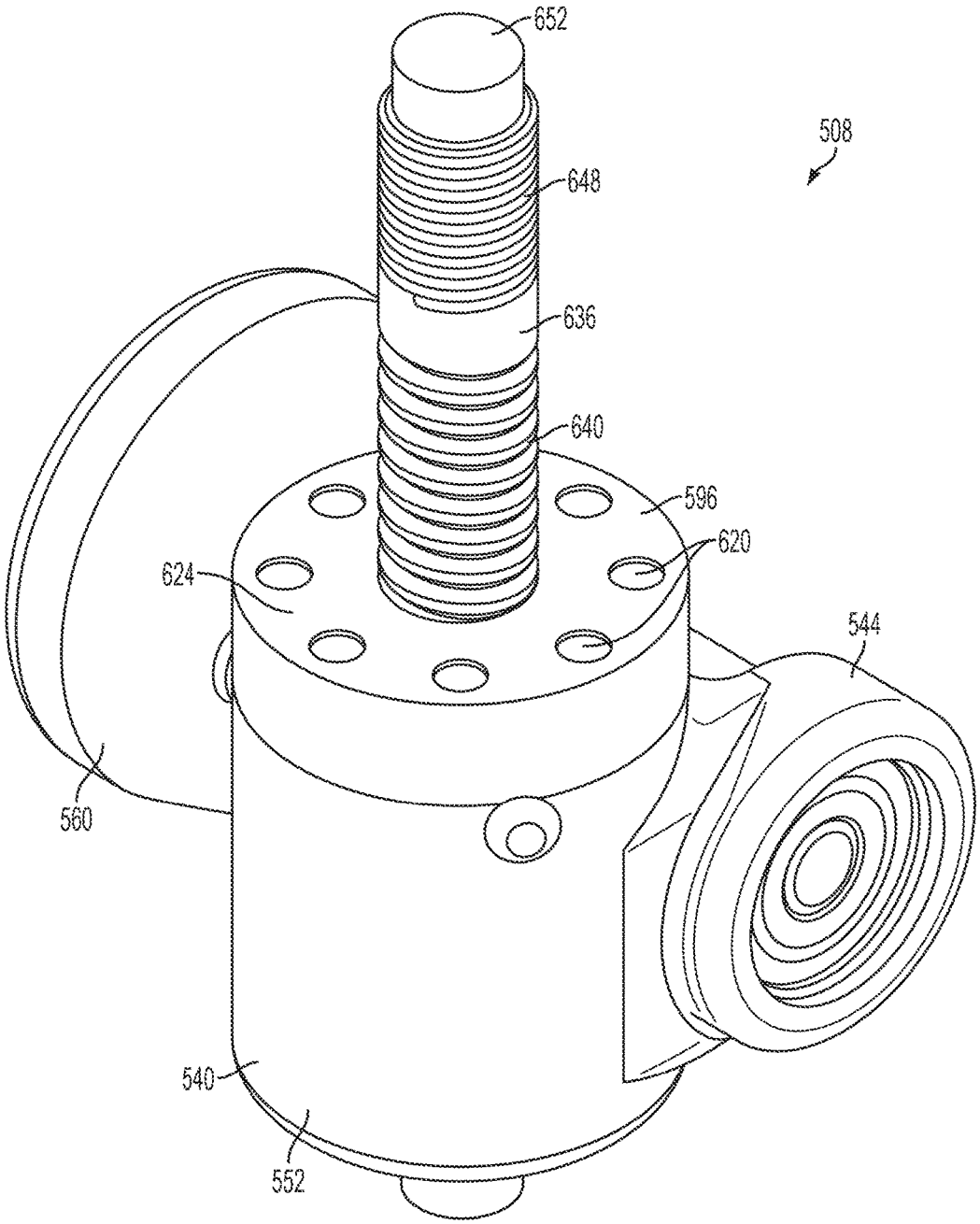
FIG. 3 is a bottom perspective view of the head unit shown in FIG. 2.
Figure 4:
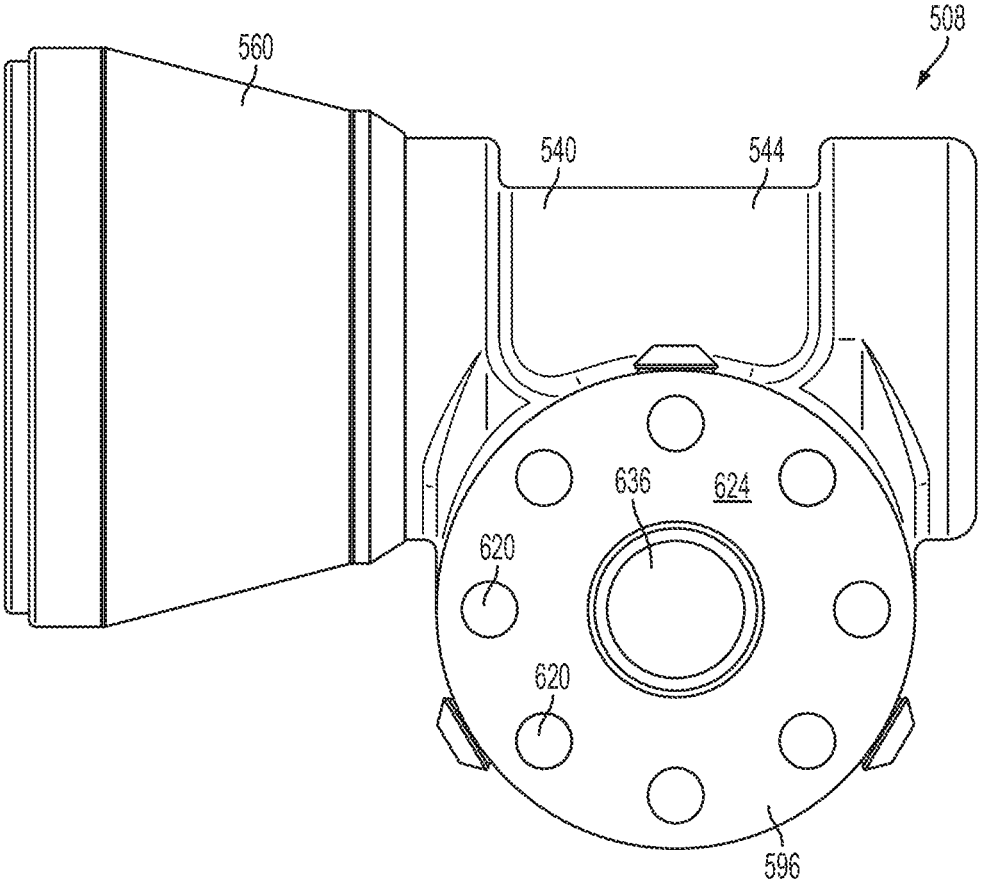
FIG. 4 is a bottom view of the head unit shown in FIG. 2.
Figure 5:
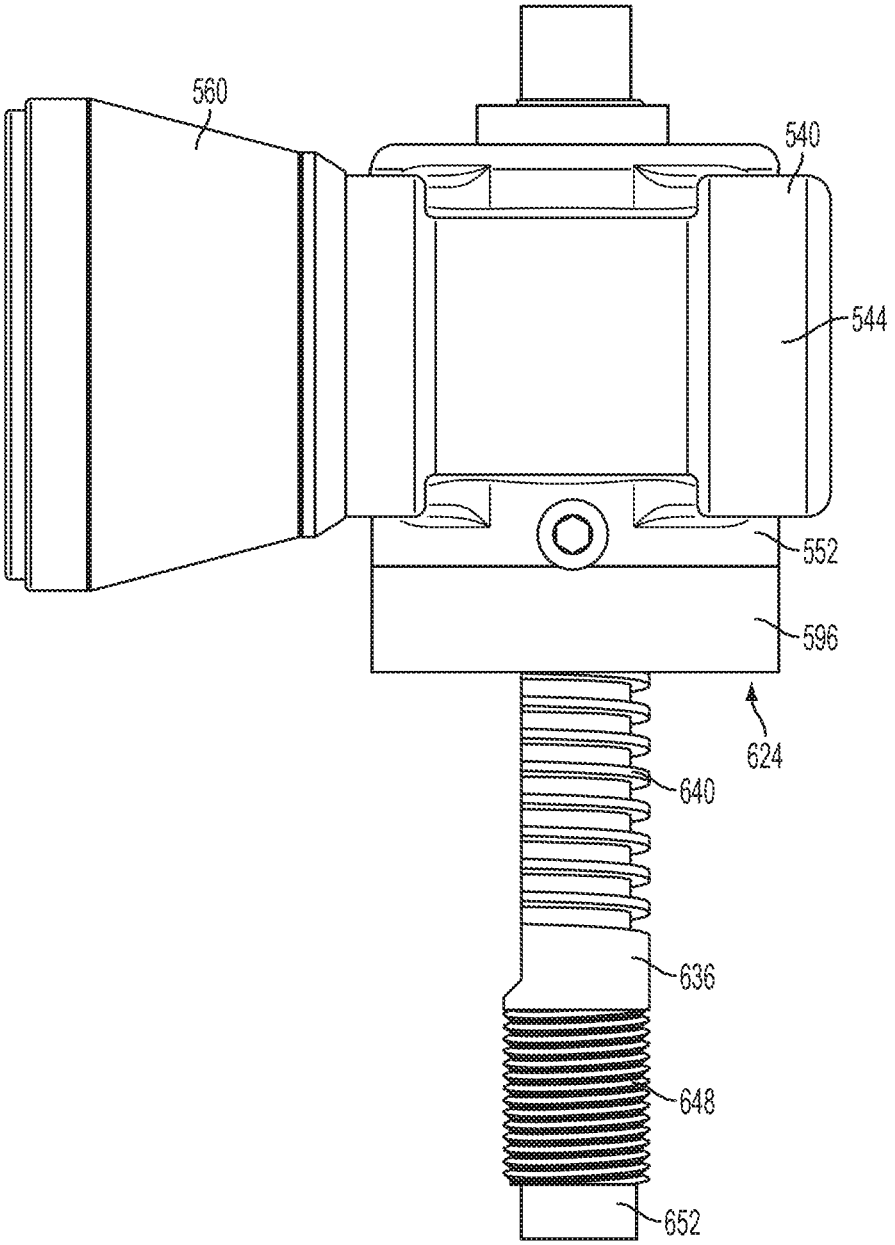
FIG. 5 is a front view of the head unit shown in FIG. 2.
Figure 6:
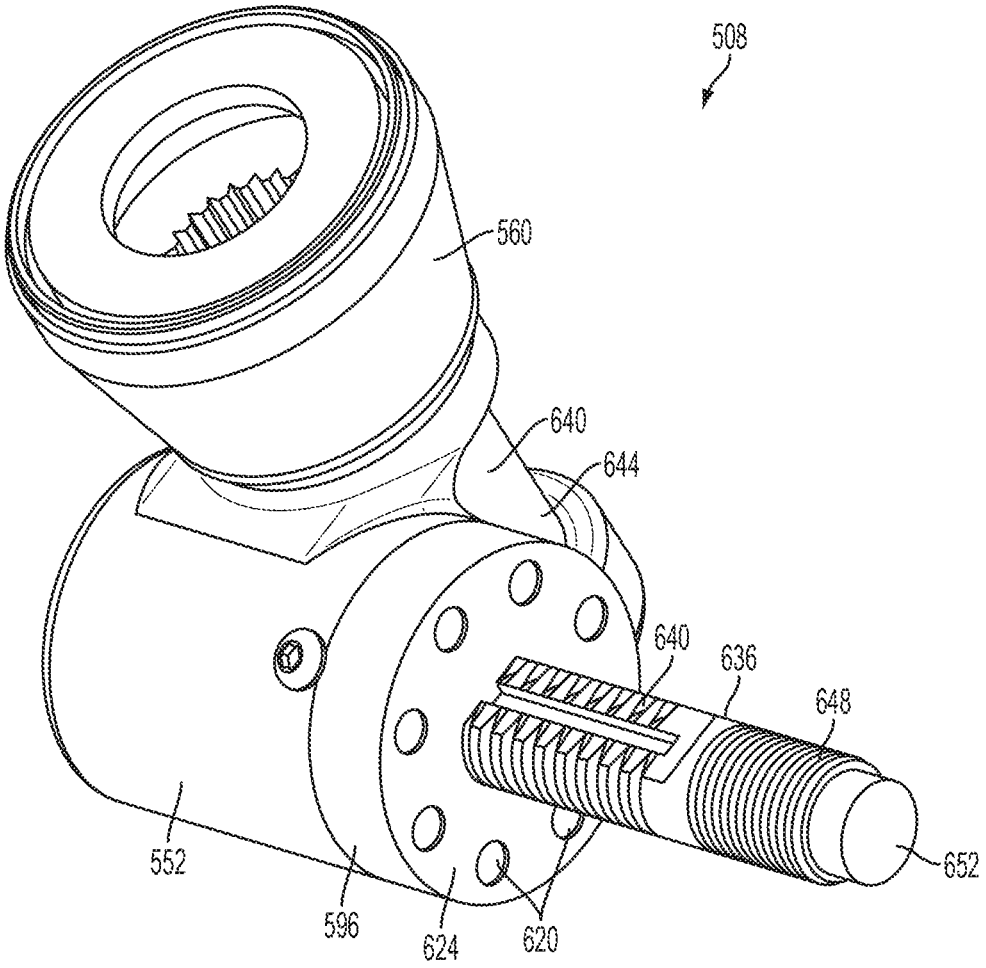
FIG. 6 is another perspective view of the head unit shown in FIG. 2.
Figure 10A:
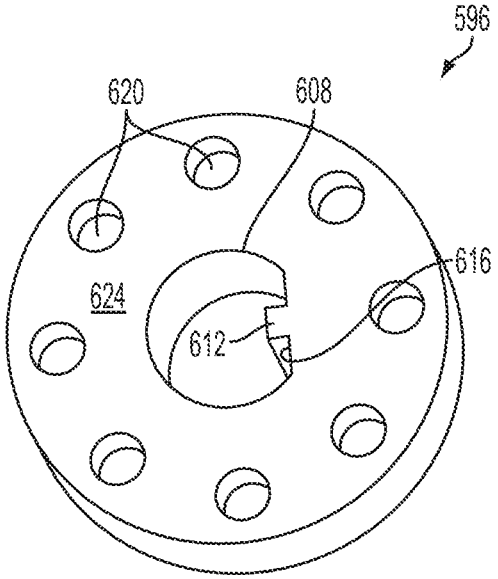
Figure 10B:
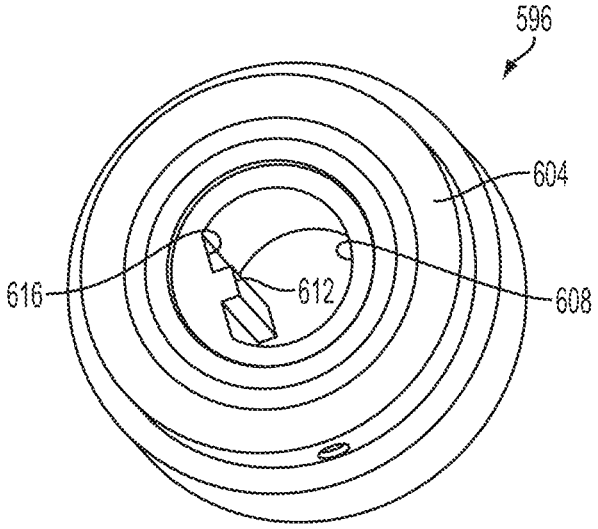

FIGS. 10*a* and 10*b* illustrate a cap of the head unit shown in FIG. 2.

Figure 11:
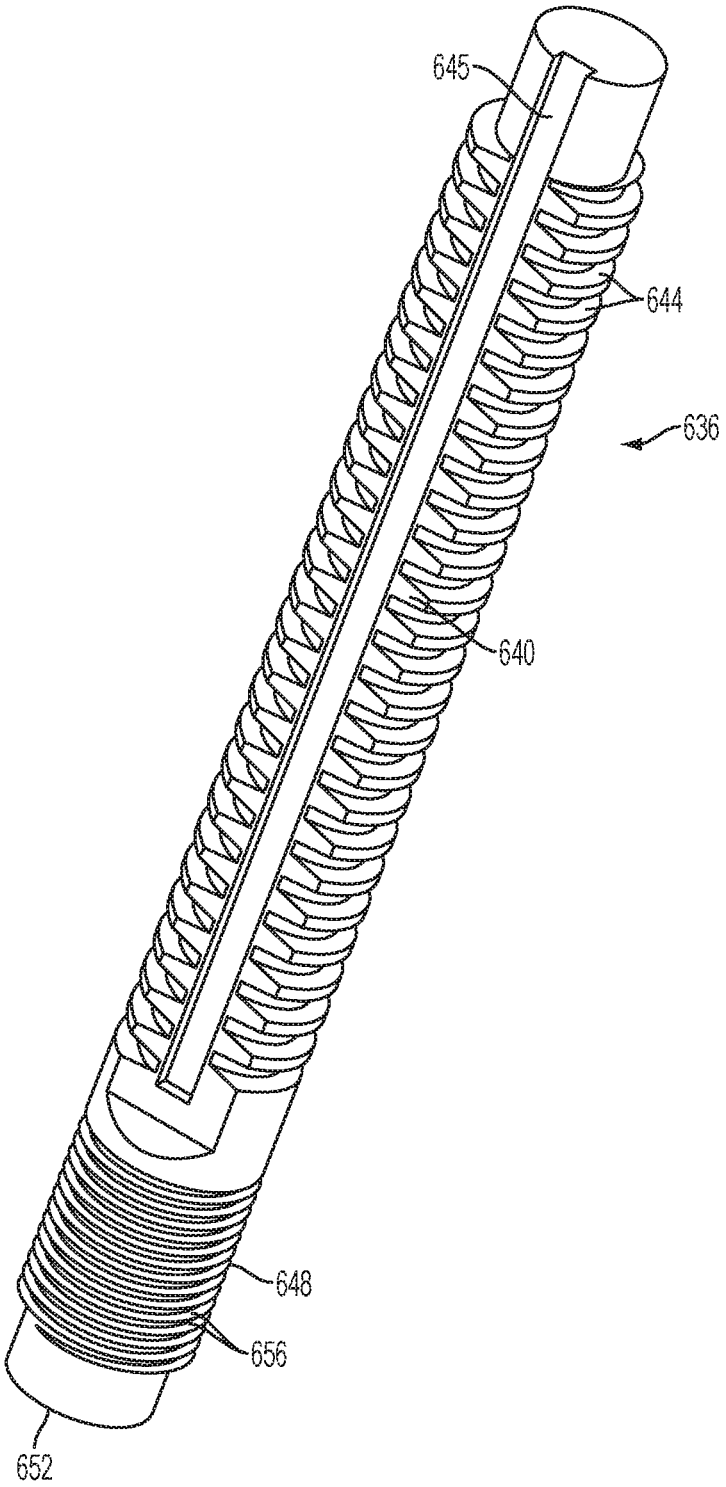

FIG. 11 illustrates a draw stud of the head unit shown in FIG. 2.

Figure 1:
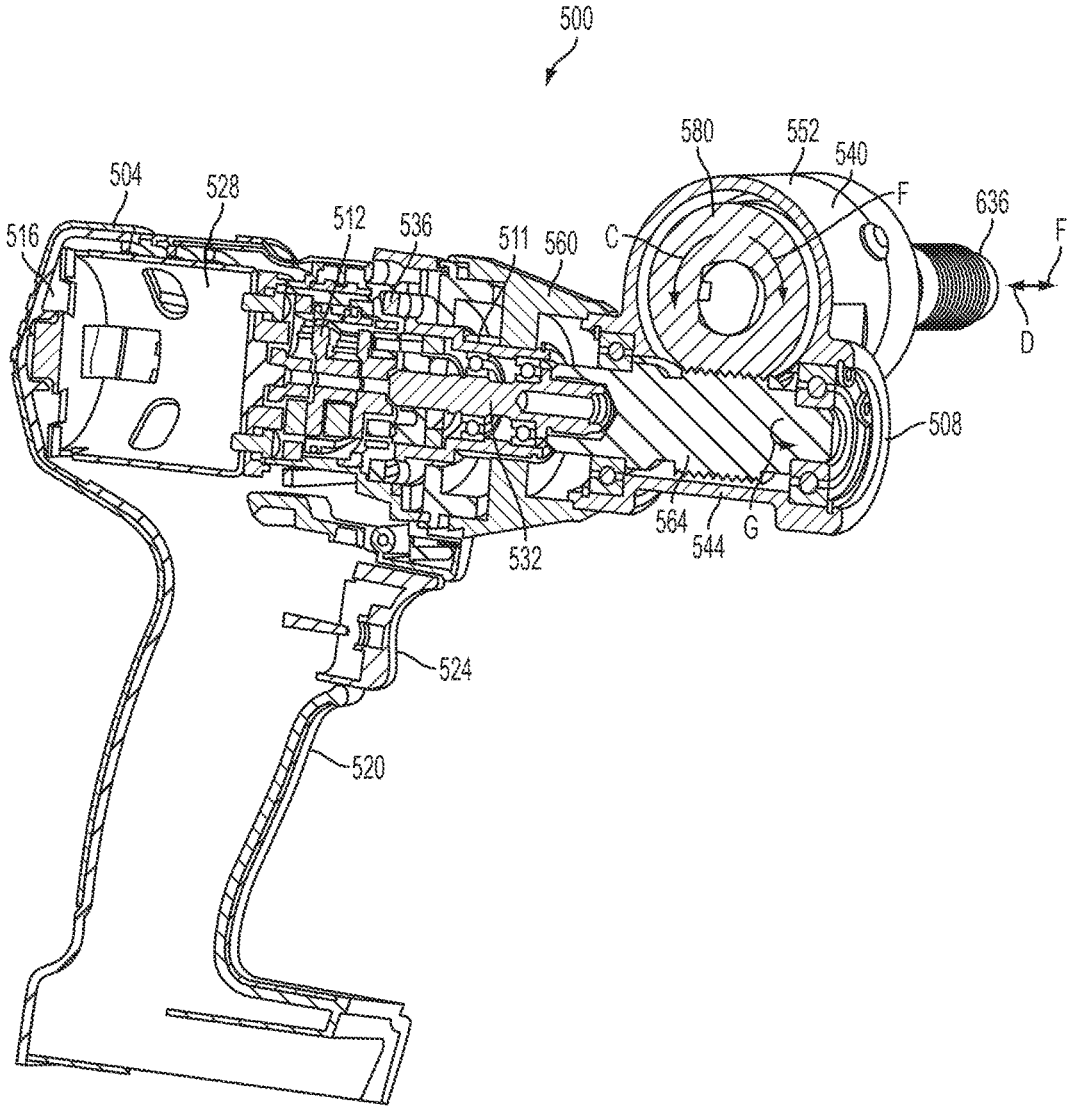
FIG. 1 is a section view of a knockout driver.
Figure 12:
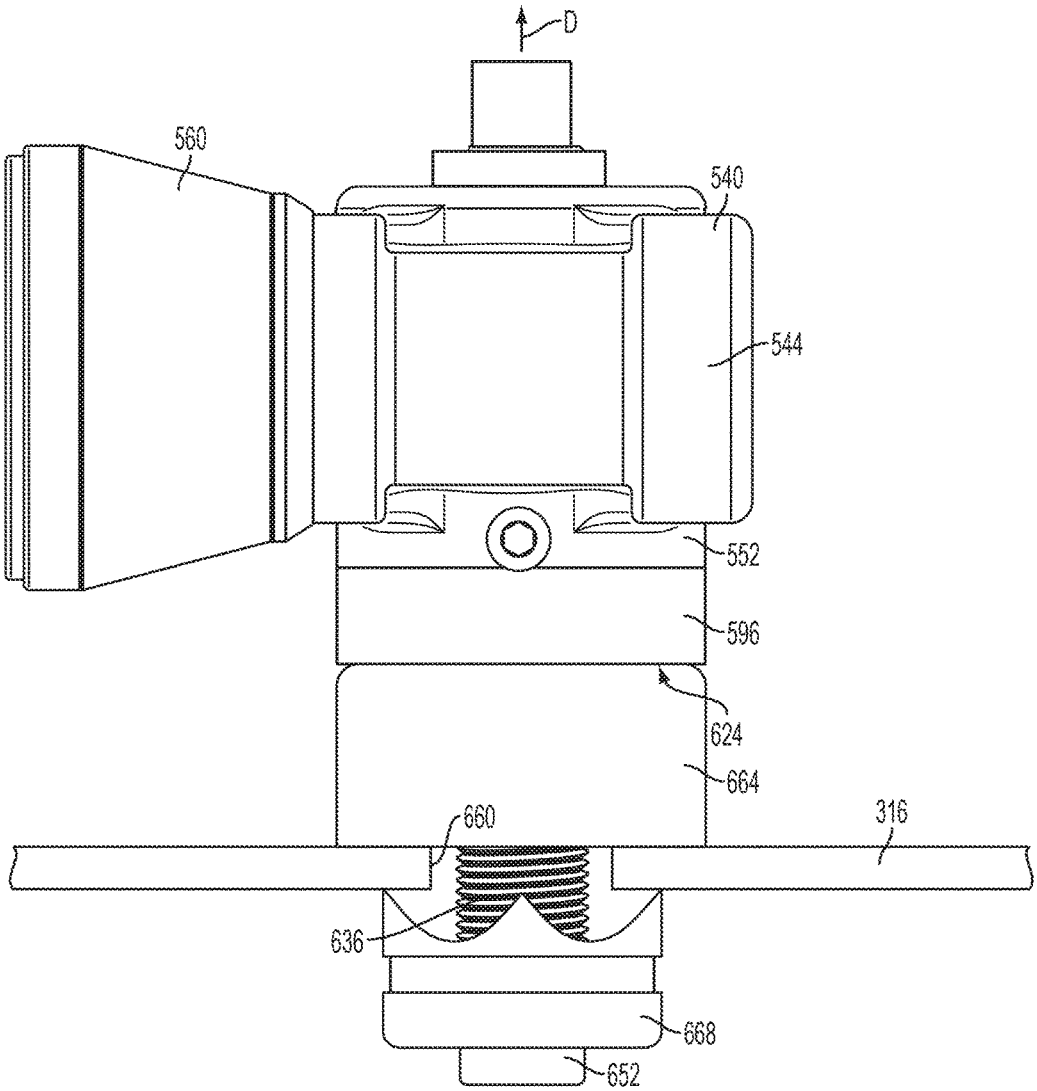

FIG. 12 illustrates the head unit of the knockout driver of FIG. 1 in use to punch a hole in sheet metal.

DETAILED DESCRIPTION

Before any independent embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

FIGS. 1-10 illustrates a powered hand-held knockout driver 500 to be used in conjunction with a punch and die set to form apertures in sheet material (e.g., sheet steel and the like). The driver 500 includes a main housing 504, a head unit 508 coupled to the main housing 504, and a drive assembly 512 positioned within the main hosing 504 and operatively coupled to the head unit 508. In the illustrated embodiment, the main housing 504 is substantially similar in shape to the housing of a power drill. More specifically, the housing 504 includes a main chamber 516, configured to house elements of the drive assembly 512, and a handle portion 520, which extends from the main chamber 516 and provides an ergonomical place for the user to grasp the driver 500. The handle 520 also includes a trigger 524 configured to operate the driver 500.

Referring to FIG. 1, the drive assembly 512 of the driver 500 includes a motor 528, an output shaft 532, and a gear assembly 536 extending between and configured to transmit torque between the motor 528 and the output shaft 532. In the illustrated embodiment, the motor 528 is powered by an 18V rechargeable battery, however in further embodiments, the motor may be powered by a battery having a greater or lesser voltage, an AC design, pneumatic, or the like.

Figure 7:
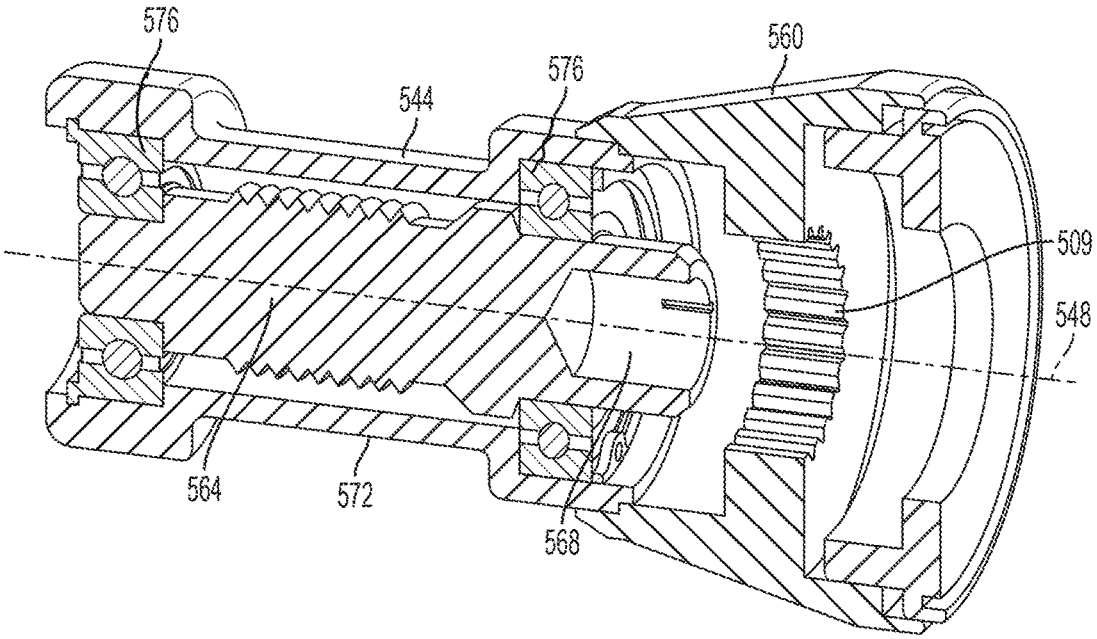
FIG. 7 is a section view taken along lines 7-7 of FIG. 2.
Figure 8:
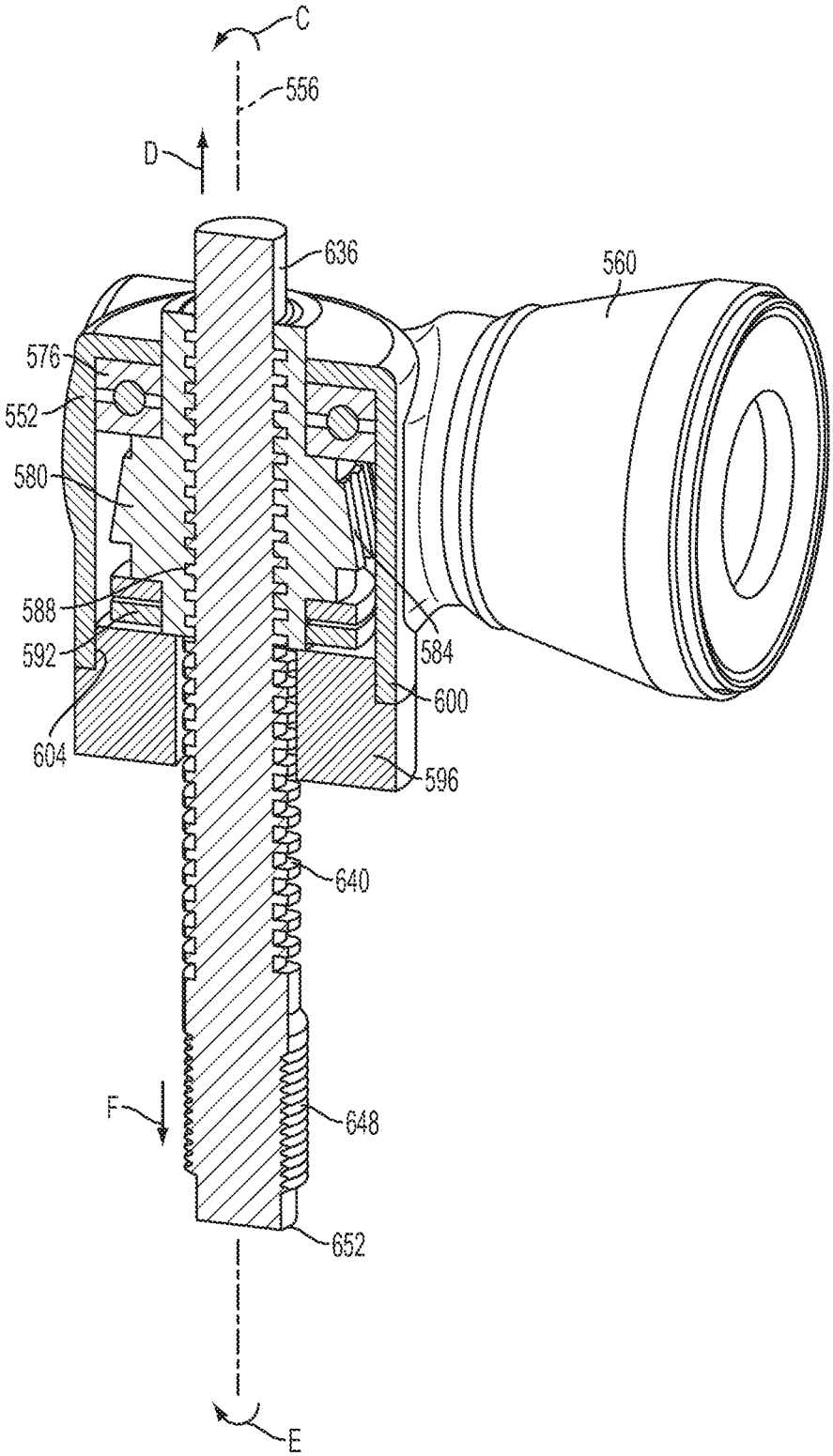
FIG. 8 is a section view taken along lines 8-8 of FIG. 2.
Figure 9:
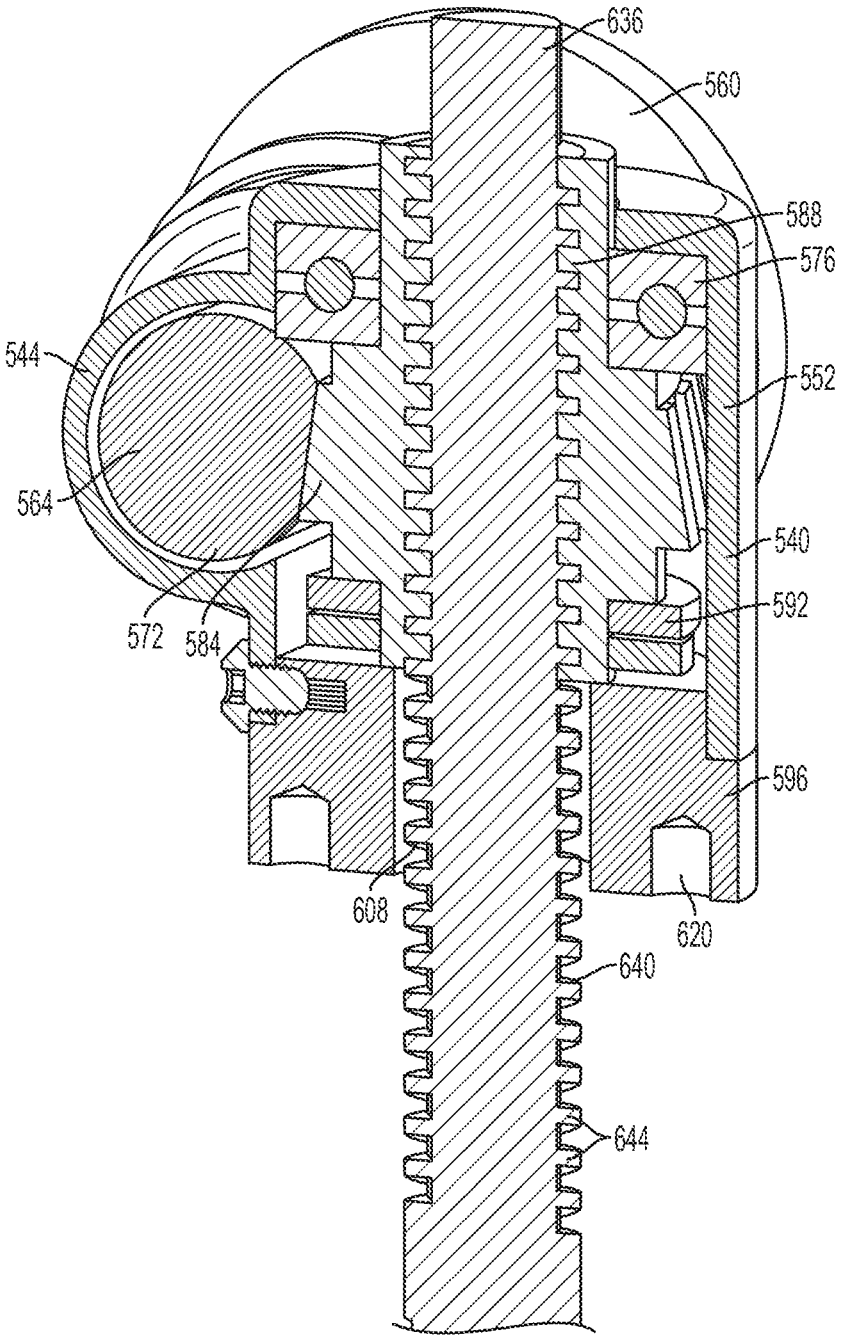
FIG. 9 is a section view taken along lines 9-9 of FIG. 2.

Referring to FIGS. 2-9, the head unit 508 of the driver 500 includes a body 540 having a first cylindrical portion 544 defining a first axis 548 and a second cylindrical portion 552, which extends substantially perpendicular to and slightly off-set from the first cylindrical portion 544 to define a second axis 556. In the illustrated embodiment, interiors of the first and second cylindrical portions 544, 552 are open to and in communication with one another (FIG. 9).

The body 540 includes a collar 560 coupled to and extending from one end of the first cylindrical portion 544 to couple the head unit 508 to the main housing 504. In the illustrated embodiment, the collar 560 is adjustable between a first locked configuration, where the internal teeth 509 (FIG. 7) engage the external teeth 511 of the housing 504, and a second unlocked configuration, where the internal teeth 509 do not engage the external teeth 511. In the locked configuration, the body 540 of the head unit 508 is fixed with respect to the main housing 504. In the unlocked configuration, the body 540 is free to rotate about the first axis 548 with respect to the main housing 504, thereby allowing a user to adjust the driver 500 for use in difficult to reach or cramped spaces. In other embodiments, the collar 560 allows the head unit 508 to be removed from the main housing 504 for maintenance and the like. In still other embodiments, the collar 560 may serve as an adapter for installing the head unit 508 to various power tools (e.g., a drill, grinder, and the like).

Referring to FIG. 7, the head unit 508 includes an input shaft 564 positioned within and rotatable with respect to the first cylindrical portion 544 about the first axis 548. The input shaft 564 includes a first end 568 that engages the output shaft 532 of the drive assembly 512 and transmits torque therebetween. The input shaft 564 also includes a set of worm teeth 572 positioned proximate the axial center of the shaft 564. In the illustrated embodiment, the input shaft 564 is supported at both ends by a pair of bearings 576, which help reduce rotational friction within the assembly. In the illustrated embodiment, the first end 568 includes a keyway (FIG. 7) to transmit torque with the output shaft 532. However, in other embodiments the first end 568 of the input shaft 564 may include splines, or grooves to facilitate torque transmission with the output shaft 532.

Referring to FIG. 8, the head unit 508 also includes a worm wheel 580 positioned within and rotateable with respect to the second cylindrical portion 552 of the body 540 about the second axis 556. The worm wheel 580 includes a first set of gear teeth 584 extending radially outward from an external surface of the wheel 580 and a second set of gear teeth 588 extending radially inward from an internal surface of the wheel 580. When the driver 500 is assembled, the first set of gear teeth 584 mesh with the worm teeth 572 of the input shaft 564, and the second set of gear teeth 588 mesh with the teeth of a draw rod 636. In the illustrated embodiment, the worm wheel 580 is radially positioned within the second cylindrical portion 552 by a bearing 576 and axially positioned by a thrust bearing 592.

Referring to FIGS. 8-10*b*, the head unit 508 also includes a substantially cylindrical end cap 596 coupled to a bottom end 600 of the second cylindrical portion 552 of the body 540. The end cap 596 includes a mounting flange 604 extending axially from the cap 596 to be received within and co-axially align the cap 596 and the second cylindrical portion 552. The end cap 596 also defines a substantially "D" shaped aperture 608 co-axial the second axis 556 and extending therethrough. In the illustrated embodiment, the aperture includes a flat surface 616 and the cap 596 includes a protrusion 612, extending inwardly into the aperture 608 (FIG. 10*a*).

The end cap 596 includes a plurality of coupling members or magnets 620 embedded within and positioned evenly over a contact surface 624 of the end cap 596. During operation, the magnets 620 are configured to attract one of the die or punch against the contact surface 624. The contact surface 624 acts as an anvil against which the punch or die may rest to absorb the forces produced during the punching process.

Referring to FIG. 11, the head unit 508 includes the draw rod 636, which is threadably coupled to the worm wheel 580 and moveable axially along the second axis 556. The draw rod 636 includes a first portion 640 having a substantially "D" shaped cross-section that is configured to be received and move within the aperture 608 of the end cap 596. In the illustrated embodiment, the first portion 640 is shaped such that it cannot rotate within the aperture 608, and is thereby restricted to axial movement only. The first portion 640 also includes a first set of threads 644 extending an axial length of the first portion 640 over a portion of the circumference. In the illustrated embodiment, the first set of threads 644 mesh with the second set of gear teeth 588 of the worm wheel 580. The first portion 640 also includes an axially extending channel 645 configured to receive the protrusion 612 therein.

During operation, the worm wheel 580 is driven by the input shaft 564, via the gear teeth 572, 584, once the motor 528 is actuated. Rotation of the worm wheel 580 about the second axis 556 causes the draw rod 636 to move axially within the aperture 608. More specifically, when the worm wheel 580 rotates in a first direction C, the draw rod 636 moves in a first direction D, and when the worm wheel 680 rotates in a second direction E, opposite the first direction C, the draw rod 636 moves in a second direction F opposite the first direction D (FIG. 8).

The draw rod 636 also includes a second portion 648 proximate the distal end 652 that has a substantially circular cross-section forming a second set of threads 656. When assembled, one of the punch or the die (not shown) is threadably coupled to the second portion 648 of the draw rod 636.

Illustrated in FIG. 12, to punch a hole in sheet material using knockout driver 500, a preliminary aperture 660 is first drilled into the sheet material 316 proximate a center of the hole to be punched. Insert the distal end 652 of the draw rod 636 through a die 664, and move the die 664 along the draw rod 636 until it contacts and is retained against the contact surface 624 by the one or more magnets 620. Insert the distal end 652 of the draw rod 636 through the aperture 660 in the sheet material, and threadably couple the punch 668 to the draw rod 636. The cutting surface of punch 668 should face the material to be cut.

With the setup complete, the user activates the driver 500 by depressing the trigger 524, which causes the motor 528 to rotate. As the motor 528 rotates, torque is transferred via the gear set 536 to the output shaft 532, which in turn rotates the input shaft 564 of the head unit 508 in a first direction G (FIG. 1). The input shaft 564 then rotates the worm wheel 580 in a first direction C, which in turn causes the draw rod 636 to move in the first direction D (described above) and imparts tension on the draw rod 636.

As the motor 528 continues to provide torque, the punch is drawn toward the die until enough force is created to physically cut (e.g., punch) the sheet material and create the desired aperture.

The system may then be reset by reversing the rotation of the motor 528, causing the input shaft 564, worm wheel 580, and draw stud 636 to all reverse direction, which displaces the punch away from the die.

Although not shown in the illustrated embodiment, the driver 500 may also include a clutch, or other form of disengagement to operatively separate the head unit 508 from the drive assembly 512.

In some alternate embodiments, the knockout driver embodiment can be modified to be a push driver, instead of a pull, as shown.

Various features of the invention are set forth in the following claims.

What is claimed is:

1. A hand-held knockout punch driver comprising:

a housing;

a motor positioned within the housing;

a drive assembly at least partially positioned within the housing and including an output member movable relative to the housing;

a head unit including a body, an input member movable relative to the body, and a draw rod that is axially movable relative to the body in response to rotation of the motor to which at least one of a punch or a die is attachable; and a quick-release mechanism for removably coupling the body to the housing, the quick release mechanism including an external collar coupled to one of the housing or the head unit, the collar being graspable from an exterior of the housing or the head unit, wherein the collar defines an internal space in which the output member is at least partially positioned, wherein the collar is axially movable with respect to the output member between a first position in which the body is locked to the housing and a second position in which the body is unlocked and removable from the housing, and wherein the output member is engageable with the input member, and the body is separately coupled to one of the housing or the collar.

2. The hand-held knockout punch driver of claim 1, wherein the body is adjustable relative to the housing in at least one of the first position or the second position of the collar.

3. The hand-held knockout punch driver of claim 2, wherein the drive assembly is positioned between the motor and the head unit.

4. The hand-held knockout punch driver of claim 3, wherein the body, in at least one of the first position or the second position of the collar, is rotatable relative to the housing about a longitudinal axis of the output member.

5. The hand-held knockout punch driver of claim 4, wherein the body is rotatable relative to the housing about the longitudinal axis while the output member is engaged with the input member.

6. The hand-held knockout punch driver of claim 1, wherein the quick-release mechanism includes a plurality of radially inward-extending locking members on one of the housing or the body, and a plurality of radially outward-extending locking members on the other of the housing or the body engageable with the radially inward-extending locking members to lock the body to the housing.

7. The hand-held knockout punch driver of claim 6, wherein adjacent radially outward-extending locking members define a recess therebetween in which at least one of the radially inward-extending locking members is received to lock the body to the housing.

8. The hand-held knockout punch driver of claim 1, wherein the drive assembly is positioned between the motor and the head unit.

9. The hand-held knockout punch driver of claim 8, wherein the output member transfers energy from the drive assembly to the input member of the head unit to impart axial movement to the draw rod.

10. The hand-held knockout punch driver of claim 9, wherein the output member is cylindrical.

11. The hand-held knockout punch driver of claim 9, wherein the output member is at least partially received in the body when the body is coupled to the housing.

12. The hand-held knockout punch driver of claim 11, wherein the body is rotatable relative to the housing about a longitudinal axis of the output member to adjust a position of the draw rod relative to the housing.

13. The hand-held knockout punch driver of claim 12, wherein the draw rod is non-coaxial with the longitudinal axis.

14. The hand-held knockout punch driver of claim 13, wherein the draw rod is transverse to the longitudinal axis.

15. The hand-held knockout punch driver of claim 1, further comprising a power source carried onboard the housing for supplying power to the motor.

16. The hand-held knockout punch driver of claim 15, wherein the power source is a rechargeable battery.

17. The hand-held knockout punch driver of claim 16, wherein the motor is a direct current motor, and wherein the rechargeable battery has a nominal voltage of at least about 18 volts.

18. The hand-held knockout punch driver of claim 1, wherein the head unit includes a contact surface against which one of the punch or the die is abuttable, and wherein the contact surface surrounds the draw rod.

* * * * *